US009554433B2

(12) United States Patent
Saes

(10) Patent No.: US 9,554,433 B2
(45) Date of Patent: Jan. 24, 2017

(54) DRIVER SYSTEM FOR DRIVING A PLURALITY OF LED'S

(75) Inventor: Marc Saes, Eindhoven (NL)

(73) Assignee: EldoLAB Holding B.V., Son en Breugel (NL)

( * ) Notice: Subject to any disclaimer, the term of this patent is extended or adjusted under 35 U.S.C. 154(b) by 114 days.

(21) Appl. No.: 13/640,227

(22) PCT Filed: Apr. 11, 2011

(86) PCT No.: PCT/NL2011/050240
§ 371 (c)(1),
(2), (4) Date: Oct. 9, 2012

(87) PCT Pub. No.: WO2011/126374
PCT Pub. Date: Oct. 13, 2011

(65) Prior Publication Data

US 2013/0026950 A1 Jan. 31, 2013

Related U.S. Application Data

(60) Provisional application No. 61/322,550, filed on Apr. 9, 2010.

(51) Int. Cl.
*H05B 37/02* (2006.01)
*H05B 33/08* (2006.01)

(52) U.S. Cl.
CPC ..... *H05B 33/0818* (2013.01); *H05B 33/0851* (2013.01)

(58) Field of Classification Search
None
See application file for complete search history.

(56) References Cited

U.S. PATENT DOCUMENTS

| | | | | |
|---|---|---|---|---|
| 5,668,537 | A * | 9/1997 | Chansky et al. | 340/3.7 |
| 7,880,400 | B2 * | 2/2011 | Zhou et al. | 315/247 |
| 8,120,287 | B2 * | 2/2012 | Lin | H05B 33/0827 315/169.1 |
| 8,154,222 | B2 * | 4/2012 | Korsunsky et al. | 315/308 |
| 8,217,587 | B2 * | 7/2012 | Sauerlaender | H05B 33/0851 315/291 |
| 8,344,659 | B2 * | 1/2013 | Shimomura | H05B 37/0245 315/169.3 |
| 8,400,071 | B2 * | 3/2013 | Gaines | H05B 33/0815 315/185 S |
| 8,482,223 | B2 * | 7/2013 | Draper | H05B 37/0218 315/209 R |
| 2006/0038803 | A1 * | 2/2006 | Miller | H05B 33/0815 345/204 |
| 2007/0013323 | A1 * | 1/2007 | De Oto | H05B 33/0815 315/291 |
| 2009/0267534 | A1 | 10/2009 | Godbole et al. | |

FOREIGN PATENT DOCUMENTS

WO WO 2009/072058 A2 6/2009

* cited by examiner

*Primary Examiner* — Alexander H Taningco
*Assistant Examiner* — Nelson Correa
(74) *Attorney, Agent, or Firm* — Hoffmann & Baron LLP

(57) ABSTRACT

A driver system for driving a plurality of LED includes a control module having an input for receiving operating data, and at least one driver module for driving at least one of the LED. The driver module includes a hysteretical converter for generating a current to power the LED, and a controller electrically connected to the hysteretical converter for controlling the hysteretical converter.

17 Claims, 9 Drawing Sheets

DRIVER SYSTEM FOR DRIVING A PLURALITY OF LED'S

CROSS-REFERENCE TO RELATED APPLICATIONS

This application is the National Stage of International Application No. PCT/NL2011/050240, filed Apr. 11, 2011, which claims the benefit of U.S. Provisional Application No. 61/322,550, filed Apr. 9, 2010, the contents of which is incorporated by reference herein.

FIELD OF THE INVENTION

The invention relates to a driver system for driving a plurality of LED's.

BACKGROUND OF THE INVENTION

It is known to drive a plurality of LED's by means of a bus structure such as a DMX bus structure. Thereto, each LED or groups of LED's are each driven by a driver, each driver being provided with a DMX bus interface via which it is connected to the DMX bus. A master is provided that controls the DMX bus and communicates data, such as setpoint (i.e. setpoint) data, error data, diagnostic information, etc between the master and drivers. Thereby, a modular configuration is created that allows expansion by additional drivers, while allowing to control all drivers (almost) simultaneously via the bus.

In such a configuration, each driver comprises a DMX controller, e.g. a DMX control chip, and a circuit to generate a supply current for the LED's, commonly a converter such as a switched mode converter which may comprise a variety of components such as a switched mode converter control chip, an inductance, a switch such as a power transistor, a reverse diode and possibly a current sense resistor to provide a feedback to the switched mode converter chip.

The above mentioned electrical components required for driving each LED or group of LED's results in a quite significant cost and a driver having a relatively large physical size, which may, in larger configurations where many LED's and many drivers are used, have a significant impact on a total cost and a total physical size.

It is desirable to provide a driver configuration that may have the potential to be more effective in terms of physical size and/or cost.

SUMMARY OF THE INVENTION

According to an aspect of the invention, there is provided a driver system for driving a plurality of LED's, the driver system comprising:

a control module having an input for receiving operating data, and at least one driver module for driving at least one of the LED's, the driver module comprising a hysteretical (i.e. hysteretic) converter for generating a current to power the LED's, and a controller (such as a microcontroller, an FPGA, etc) electrically connected to the hysteretical converter for controlling the hysteretical converter. The control module and the at least one driver module may be interconnected by a bus structure, e.g. a data communication bus such as a serial data communication bus. A hysteretical converter, an example of which will be provided below, allows to implement a converter to convert a supply voltage into a supply current for the LED's, such as a switched mode converter, at a low component count. The term hysteretical converter is to be understood as a converter comprising a reference source, a comparator for comparing a signal representing a current supplied by the converter with a reference signal, such as a reference voltage supplied by the reference source, and a switch driven by the comparator, so that a transition of an output level of the comparator results in a switching of the switch from conductive to non conductive or vice versa. The switch connects in conductive state an inductor to a supply terminal for charging the inductor and disconnects it from the supply terminal in the non conductive state thereof. Optionally, hysteresis is provided to the comparator, from which the name hysteretical converter has been derived. It is however emphasized that such hysteresis may also be omitted. The hysteretical converter may also be referred to as a free running, self oscillating converter. Due to its simplicity, a low component count may be realized.

Furthermore, many microcontroller chips presently on the market are provided with an integrated comparator or an integrated operational amplifier that may be applied as a comparator. Also, a reference source, or programmable reference source may be comprised in such a microcontroller chip. Thereby, component count may be further reduced. Also, functionality to implement a (e.g. serial) bus interface is provided in many microcontrollers, thereby still further reducing component count. In an embodiment, at least one of the comparator and the reference source are controllable by the controller itself, which allows to influence an operation of the converter (e.g. enabling/disabling the comparator, and/or e.g. setting or periodically altering a level of the reference signal), which allows to accurately control an operation of the converter, thereby allowing a versatile control of the operation of the converter—while still maintaining the low component count, hence low cost and low physical dimensions.

Hence, in accordance with the invention, a modular approach is provided allowing to control a plurality of drivers for a plurality of LED's or LED groups, thereby providing intelligent control by means of the central control module and low component count of each of the drivers (i.e. driver modules) It will be understood that the modules (i.e. control module, driver module, etc) may—but not necessarily need to—form separate entities. Some or all of the modules may be integrated as a single entity, for example on a single printed circuit board.

BRIEF DESCRIPTION OF THE DRAWINGS

Further features and advantages of the invention will become apparent from the enclosed drawings in which non limiting embodiments of the invention are depicted, wherein.

DETAILED DESCRIPTION OF THE INVENTION

Figure 1A:
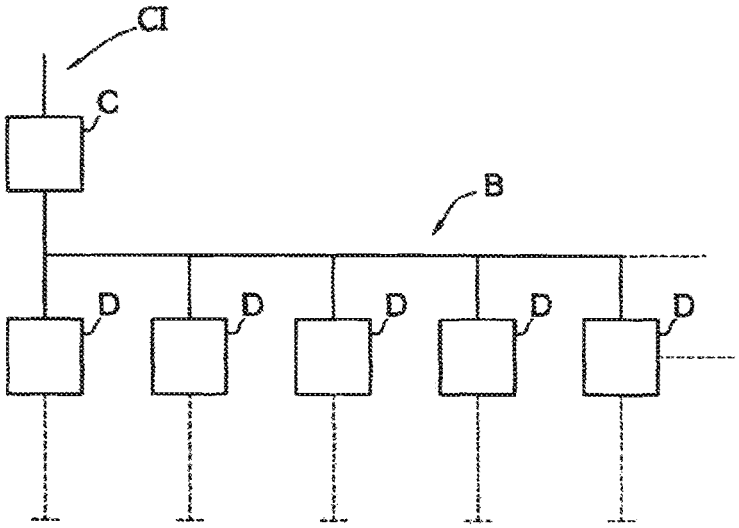
FIGS. 1 A and B depict examples of driver structures in accordance with an aspect of the invention.
Figure 1B:
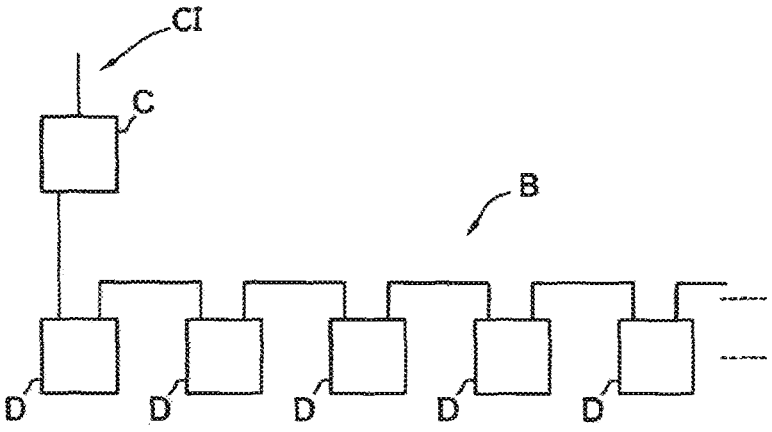

FIGS. 1A and 1B each depict a configuration of a driver system for driving a plurality of LED's. Each driver system comprises a control module C and a plurality of driver modules D. Each driver module is arranged to drive at least one LED. The driver modules are connected to the control module by means of a bus structure B, which is, in the case of FIG. 1B, a daisy chained bus structure. The control module is provided with a control input CI for receiving operating data, such as a digital bus interface, an analogue input for receiving an analogue signal representing e.g. a desired intensity, an input for receiving a pulse width modulation signal, a configuration code, etc.

Figure 2:
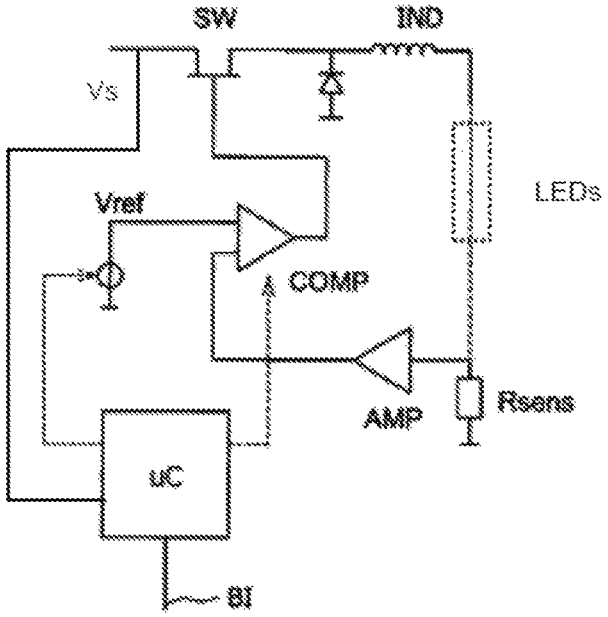
FIG. 2 depicts a schematic diagram of an embodiment of a hysteretic converter that may be applied in the driver structures in accordance with the invention.

FIG. 2 depicts an example of a driver module comprising a hysteretical converter. The circuit comprises a switch SW, such as a field effect transistor or other semiconductor switching element, powered by supply voltage Vs and in series connection with an inductor IND. The current flowing through the inductor then flows through the LED's, e.g. in series connection. Furthermore, in series with the LED's and inductor, a resistor Rsens (also referred to as current measurement resistor, current sensing resistor or sensing resistor) is provided in order to sense a value of the current. The current value results in a voltage drop over the resistor Rsens, which is amplified by amplifier AMP and provided to an input of comparator COMP. Another input of the comparator is provided with a reference signal, in this embodiment a reference voltage provided by reference source Vref (also referred to as reference or reference signal generator). An output signal of the comparator, which represents a result of the comparison, is provided to a controlling input of the switch, in this example to the gate of the field effect transistor. A regenerative circuit is provided now, whereby a value of the current through the inductor, LEDs and measurement resistor averages a value at which the input of the comparator to which the amplifier is connected, equates the value of the reference voltage, thereby the comparator and switch periodically switching, resulting in a ripple on the current as well as on the voltage sensed by the resistor Rsens. At least one of the comparator COMP and reference source Vref is controllable by microcontroller uC and may form an integral part of a microcontroller chip. The comparator may be controllable by the microcontroller via an enable/disable input of the comparator. The reference source may be controllable by means of a microprocessor controllable attenuator of the reference source, that e.g. acts as a programmable voltage divider. The microcontroller is further provided with a bus interface BI for connection to the bus structure B as depicted in FIG. 1. A and B. In a practical embodiment, the comparator, the reference source and the amplifier may be integrated, together with the microprocessor, onto a single chip such as a commercially available microprocessor provided with suitable programming instructions so as to perform the desired tasks. Preferably, a single wire bus structure B is applied, as it requires only a single input/output pin of the microcontroller chip, thereby allowing to make use of a low cost, low input/output pin count microcontroller chip. As a result, only few external components are required, namely the switch SW, inductor and reverse diode, and possible the sensing resistor Rsens.

The controller uC may be arranged (e.g. provided with program instructions that enable the controller to perform the stated task) to measure a value of a supply voltage Vs thereby using the reference signal generator as a reference. The control module may thereby be arranged to compare the measurements of the values of the supply voltages Vs of at least two driver modules with each other and to calibrate the reference signal generators of the driver modules in respect of each other. In this embodiment, use is made of the fact that the driver modules may each be provided with a same supply voltage Vs. Hence, differences in the (e.g. internal) reference sources, such as bandgap references of each of the driver modules, may be detected by measuring the supply voltage Vs—which implies comparing the supply voltage Vs with the reference source (i.e. the reference signal generator)—equal values of the reference would yield a same measurement result for the measurement of the supply voltage Vs. Hence, the references may be calibrated for each of the drivers so as to provide a high reference accuracy and hence a high reproducibility throughout the different drivers without a need for highly accurate (costly) references.

In an embodiment, the control module is arranged to measure the supply voltage Vs and to send data representing a value of the supply voltage Vs to the or each driver modules, thereby simplifying an operation of each of the driver modules, as they do not need to take account of any fluctuations in the supply voltage Vs themselves: instead, this is measured centrally and forwarded to each of the drivers via the communication bus. The driver modules may also measure the supply voltage Vs themselves and compensate as referred to above.

In an embodiment, a testing switch is provided to connect, in a conductive state thereof, a current output of a first one of the driver modules to a current measurement input of a second one of the modules, the control module being arranged to test the first one of the driver modules by setting the switch to a conductive state and measuring the current supplied by the first one of the driver modules via the second one of the driver modules. Thereby, a self test may be performed.

In an embodiment, the control module is arranged to test the first one of the driver modules by activating the hysteretical converter of the first one of the driver modules and requesting from each driver module a current measurement. Thereby, the driver modules may be tested one by one. Each driver module is operated, the current is measured in each driver module. In case of incorrect wiring or LED's, etc, an activation of one of the driver module could result in a current path to another one of the driver modules, which may then be detected as described here. Hence, such wiring errors at the installation may be detected by a simple software routine and without a need for additional hardware.

In an embodiment, the driver module is arranged to measure a voltage over the to be driven at least one LED, and to generate an error message in case the measured voltage is below a predetermined threshold. Thereby, an error condition of a LED or LED group connected with reversed polarity may be detected, as a reverse polarity protection diode of the LED group will in this situation go into a conductive state and its forward voltage—which is lower than the normal LED forward operating voltage—may be detected and an error message generated. In case the Led or Led group would not be provided with a reverse polarity protection diode, substantially no current will flow, which may be detected as described below.

In an embodiment, the driver module is arranged to measure a voltage over the to be driven at least one LED, and to generate an error message in case the measured voltage is above a predetermined threshold. Thereby, an open circuit (no LED or Led group connected) may be detected.

As a startup procedure, in an embodiment, the control module is arranged to activate one of the drivers, to perform a check of the operation of that driver module, prior to activating another one of the drivers, so as to allow to check operation of each of the driver modules. Many checks may be performed, such as the current measurement in each driver module as already described above.

In an embodiment, the control module is arranged to send an increased setpoint to at least one of the driver modules when an error condition in another one of the drivers has been detected. Thereby, a degradation, whereby a LED or LED group of one of the drivers malfunctions and is switched off, may be compensated to a certain extent by increasing an output of other LED's or LED groups driven by other driver modules.

In an embodiment of the hysteretic converter such as described above with reference to FIG. 2, a soft restart mechanism may be applied. In case of an overload or no load connected, a switching of the comparator COMP will stop. The stopped switching of the comparator COMP may be detected by the controller uC. The controller may be arranged to periodically restart the converter, e.g. by forcing the comparator COMP into a switching action, and detect if switching of the comparator continues or not, thereby detecting if the fault condition has been solved. In an embodiment, the controller may be arranged to control the reference source Vref so as to reduce a set-point value as provided by the reference source. As a result, a reduced converter output voltage and/or converter output current may be obtained, thereby reducing a risk of hazardous output conditions such as high output voltage peaks (for example caused by inductive load effects). This embodiment may be described as a driver module comprising a converter (such as the hysteretical converter as described in this document) and a controller for controlling the converter, wherein the controller is arranged to

- detect a short circuit or no load condition of the converter;
- drive the reference signal generator so as to reduce a value of the reference signal, and
- retry to activate the converter after waiting for a predetermined wait time period, whereby the reference signal generator is kept at the reduced value of the reference signal. The controller may further be arranged to detect is the activation of the converter succeeded and to drive the reference signal generator so as to bring the reference signal (gradually or stepwise) back to a normal level.

In case of the hysteretical converter, the detecting the short circuit or no load condition of the converter may be performed by means of a detecting by the controller whether a switching of the comparator has stopped.

It is noted that, although in FIG. 2 an amplifier AMP is depicted between the resistor Rsens and the comparator COMP, this amplifier may be omitted in other embodiments.

In an embodiment, a calibration is carried out to at least partly compensate for an imperfect line- and load regulation of the hysteretic converter. This calibration may also at least in part compensate certain component tolerances. The calibration involves determining a dependency of the average (effective) LED current from amongst others a LED current set-point, a line voltage and a load characteristic such as a load voltage. The dependency may be represented by a formula or table. The determination may be performed at design time by the designer and programmed into the microcontroller (or a memory thereof) or the measurement of the dependency may be performed by the microcontroller by carrying out measurements at several sets of input values for the variables as mentioned.

Figure 3A:
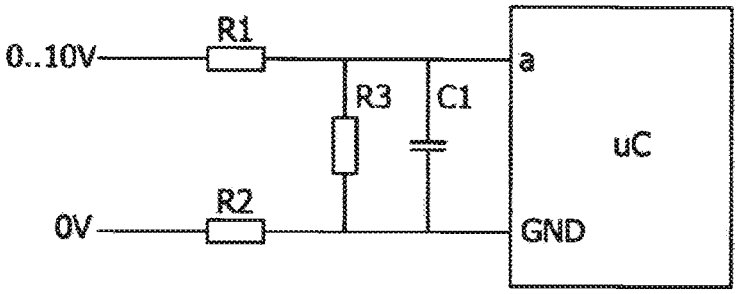
FIGS. 3A and B depict a schematic diagram of a part of a control module in accordance with an aspect of the invention.
Figure 3B:
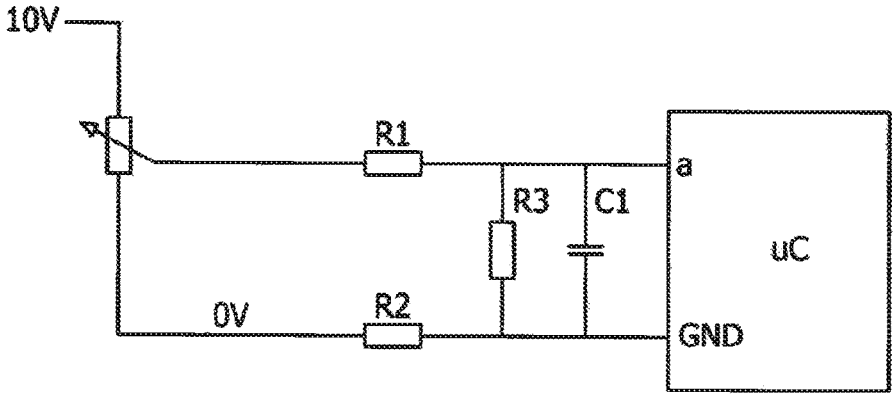

Next, the microcontroller may measure the input values and the actual output current for a given current set-point, for example at each power-up, and calibrate the hysteretic converter by applying a scale factor corresponding to a difference between the LED current as calculated using the dependency formula and the measured actual current. The scale factor can then be applied to the incoming set-point from the user thus obtaining an actual current closer to the intended current. By performing the measurement of the actual current at multiple input conditions, a more elaborate calibration can be performed in which the scale factor may be different per set of input conditions. In an embodiment, the control module comprises an analogue input having a low pass filter, the control module being arranged to derive a setpoint information from a level at the analogue input a, the control module being arranged to provide an electrical pulse onto the analogue input, to measure a decay of the electrical pulse in the filter, and to determine whether or not a setpoint source (at 0 . . . 10V) is connected from a decay of the electrical pulse in the filter. An example is depicted in FIGS. 3A and B. Here, a low pass filter is provided by resistors R1-R3 and capacitor C1. The input terminal may be driven by a variable voltage (0 . . . 10V, FIG. 3A) or a potentiometer (FIG. 3B). Also, the input terminal (0 . . . 10V) may be unconnected. If 0V is measured, it may be required to detect whether this result originates from an unconnected input terminal or a substantially zero input voltage provided from the potentiometer (FIG. 3B) or variable voltage input (FIG. 3A), which may be detected by a difference in decay characteristics in response to the electrical pulse.

A one wire bus may be applied to interconnect the control module and driver module. In order to provide an efficient data communication, hence a low cost, use may be made of a dedicated communication protocol. Furthermore, a balancing of functionality may be performed between control module and driver module. Centralized functionality in the control module may allow cost saving and/or enhanced functionality, while functionality in the control module and driver module may allow improved diagnostics by allowing comparison of measurement results and calibrations by comparison of measurement results.

A variety of techniques may be applied by the driver module in order to drive the hysteretical converter by the controller, some of these techniques are described below with reference to FIGS. 4A-4D, FIGS. 5A-5B, FIG. 6, FIGS. 7A-7C and FIGS. 8A-8C.

Figure 4A:
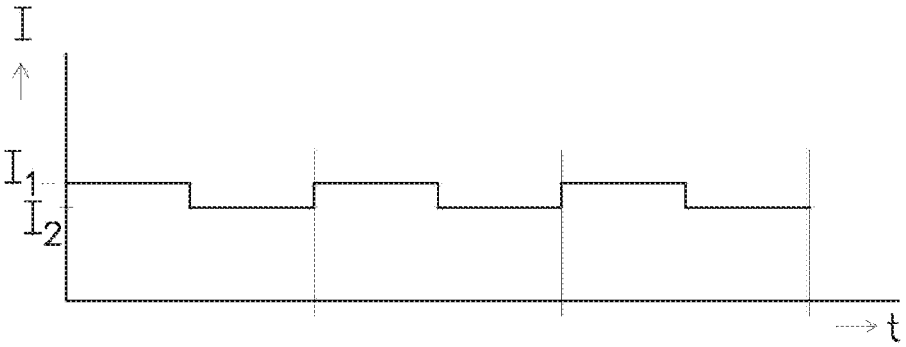
FIGS. 4 A-D depict time diagrams based on which an embodiment of the invention will be described.
Figure 6:
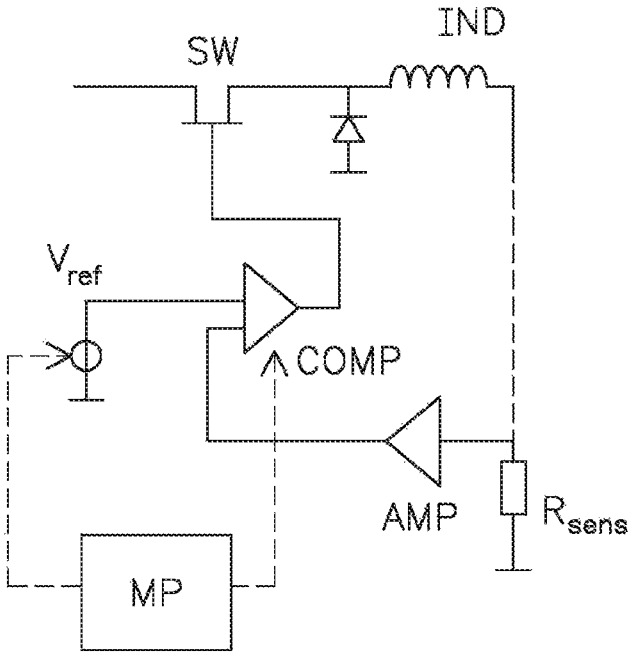
FIG. 6 depicts a schematic diagram of a circuit in to be applied in an embodiment of the invention.

FIG. 4A depicts a graphical view of the LED current I versus time. An example of a circuit to generate this current is depicted in FIG. 6. The circuit comprises a switch SW, such as a field effect transistor or other semiconductor switching element in series connection with an inductor IND. The current flowing through the inductor then flows through the LED's, e.g. in series connection. Furthermore, in series with the LED's and inductor, a resistor Rsens is provided in order to sense a value of the current. The current value results in a voltage drop over the resistor Rsens, which is amplified by amplifier AMP and provided to an input of comparator COMP. A fly-back diode is provided for allowing current flow when the switch is nonconductive. Different electrical configurations are possible, depending on the configuration, the current flows through the resistor Rsens in both the conductive and non conductive state of the switch, or only in the conductive state. Another input of the comparator is provided with a reference signal, in this embodiment a reference voltage provided by reference source Vref (also briefly referred to as reference). An output signal of the comparator, which represents a result of the comparison, is provided to a controlling input of the switch, in this example to the gate of the field effect transistor. A regenerative circuit is provided now, whereby a value of the current through the inductor, LEDs and measurement element averages a value at which the input of the comparator to which the amplifier is connected, equates the value of the reference voltage, thereby the comparator and switch periodically switching, resulting in a ripple on the current as well as on the voltage sensed by the resistor Rsens. At least one of the comparator COMP and reference source Vref is controllable by a microcontroller MP. In a practical embodiment, the comparator and reference source may be integrated, together with the microprocessor, into a single chip. Hysteresis may be added to the comparator. Therefore, the circuit topology described here sometimes being referred to as a "hysteretical converter" (with hysteresis or without).

Figure 4B:
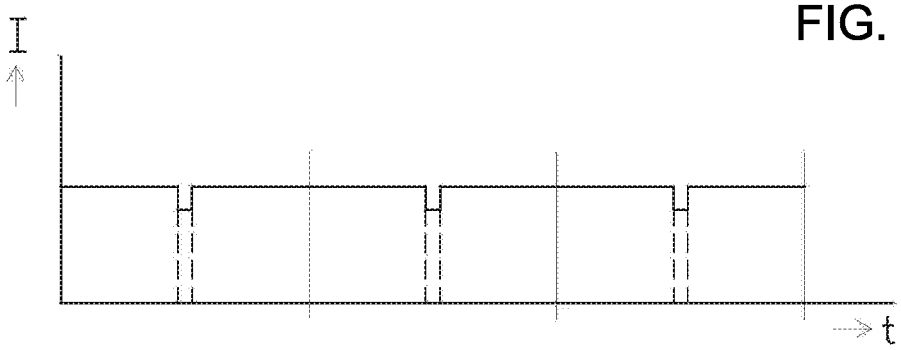
Figure 4C:
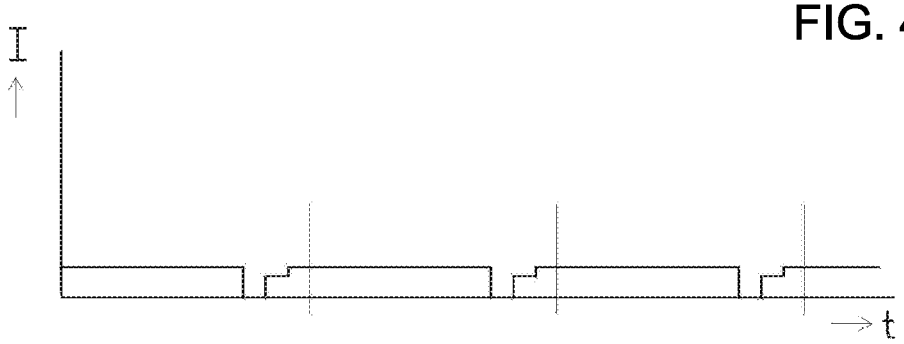
Figure 4D:
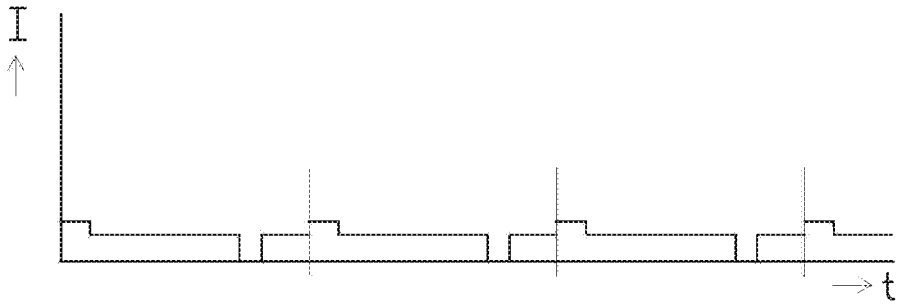

Reverting to FIG. 4A, the microprocessor (also referred to as microcontroller or controller) may control the reference source so as to provide different reference voltage values. This may for example be implemented by a microprocessor switchable resistive voltage divider network or any other suitable means. In case of an attenuation in 16 steps (by a 4 bit control) of the reference voltage, 16 different current values may be obtained, hence allowing a dimming of the LED current in 16 steps. In case a higher resolution would be required, the reference voltage may be set at a first value I1 during a first part of a cycle time, and at a second value I2 during a second (e.g. remaining) part of the cycle time. Thereby, an effective, average value of the current may be achieved in between the 16 steps, hence enabling a higher resolution dimming. A reduction of the current to a lower value during relatively shorter parts of the cycle time as depicted in FIG. 4B may allow precise adjustment of the required average current level. By controlling the reference source accordingly, the value during the short time period may be set to a desired lower or higher level, or for example to zero, so as to stop the LED current in this part of the cycle. At low current values, instability or other adverse or undesired effects may occur in the circuit as depicted in FIG. 6. Therefore, instead of setting the reference to a continuously low value (for example a value of 1 or 2 in a 4 bit coding), the value may be set somewhat higher, i.e. at a value where stable operation is ensured, whereby the current is reduced to substantially zero in a part of the cycle time, as depicted in FIG. 4C. In order to provide a smooth and defined start-up from the zero current condition, the current may, from the zero current condition, be increased stepwise, e.g. by a stepwise increase of the reference voltage value. FIG. 4D depicts the situation where during a part of the cycle the current is increased for increased resolution of the average current: e.g. in a cycle having 64 sub cycle time parts, whereby the current is set from value 3 to zero during 3 parts of the 64, an increase of the average current may be obtained at a relatively high resolution by setting the current value from 3 to for example 4 during one part of the 64, as schematically depicted in FIG. 4D. In each of the examples shown here, the current may be set by the microcontroller by controlling a value of the reference Vref. The condition of zero current may also be achieved by disabling the comparator (e.g. by an internal disabling of a microprocessor controlled comparator or by a switch or digital logic (not depicted in FIG. 6) that disables of blocks the output of the comparator.

Figure 5A:
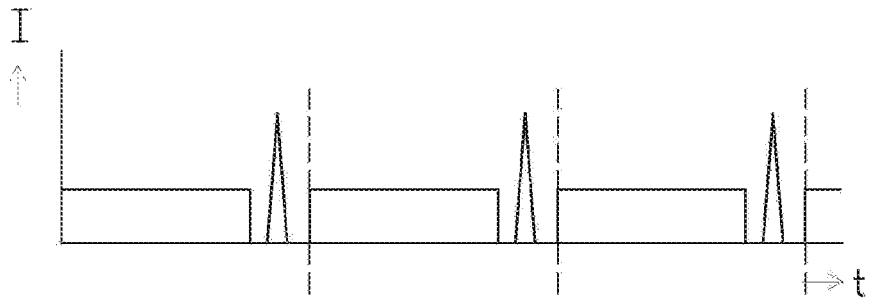
FIGS. 5 A and B depict time diagrams based on which an embodiment of the invention will be described.
Figure 5B:
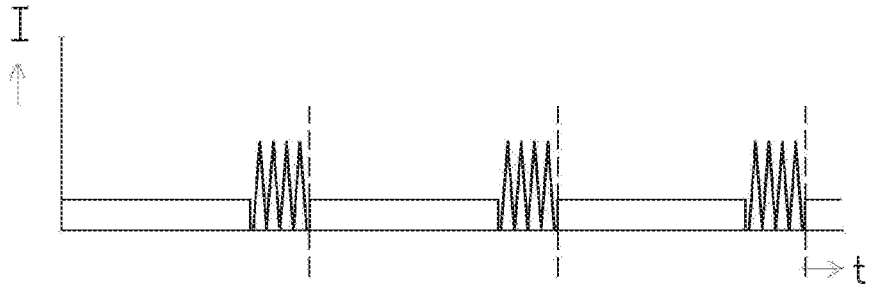

Further variants are depicted with reference to FIGS. 5 A and B. Here, a current pulse is formed during a part of the cycle time. The current pulses may be generated in many ways: it is for example possible to switch the reference Vref from zero to a certain nonzero value, which then results in an increase in the current, while after a certain time (e.g. a lapse of time determined by the microprocessor, a first switching of the comparator and switch SW to the non conductive state of the switch, etc.) the operation is stopped by for example disabling the comparator or setting the value of the reference back to zero, causing the current drop to zero again. Calibration may be performed to determine an effective current value or brightness or brightness contribution of such pulse. One pulse may be provided per cycle (FIG. 5A) or a plurality thereof (FIG. 5B). Although in FIG. 5B the pulses are depicted so as to directly follow each other, it will be understood that the pulses may also be provided with a time in between, thereby achieving a further dimming. In an embodiment, dimming may be provided by increasing a time distance between successive pulses.

By a corresponding setting of the value of the reference Vref, an amplitude of the pulse may be set. As the pulses may provide for a comparatively lower effective current then a continuous current, a resolution may be further increased by combinations of parts of the cycle during which a continuous current is provided, and parts of the cycle during which the current is pulsed. Thereby, by a corresponding setting of the reference, different values of the continuous and/or the pulsed current may be obtained within a cycle. Calibration of the pulses may be performed in various ways, e.g. timing a pulse width by a timer, filtering a sequence of pulses by a low pass filter, measuring a pulse shape using sub-sampling techniques. Also, feedback mechanisms such as optical feedback (brightness measurement) may be applied.

It will be understood that, although the above explains the controlling of the reference (so as to set the current) and the pulsing in a free running configuration as depicted in FIG. 6 (also referred to as a hysteretical configuration), the above principles may be applied in any other (e.g. switched mode converter) configuration too.

In another embodiment, asynchronous sampling is used by the microprocessor in order to determine a time of switching off the comparator. Thereto, the microprocessor samples an analogue signal representing the current through the inductor and LED's, e.g. by sampling the signal at the output of the amplifier AMP for amplifying the signal measured by Rsens. Due to the free running character of the hysteretical or other converter, an asynchronous sampling is provided enabling to determine the waveform and hence the switching on and/or off of the comparator with a comparably high resolution. For this purpose, the current may be sampled and/or the output of the comparator. In order to provide a low average current through the LED's, the microprocessor may now disable the hysteretical converter (or other type of converter) by either setting after a time (e.g. prior to the finalisation of the cycle of oscillation of the converter itself) the value of the reference source back to zero, by overriding or by disabling the comparator or by any other suitable means to force the switch SW to the desired state. As a result, comparably short current pulses are created, shorter than could have been provided by letting the oscillator run on its own motion, the current pulses having such short time duration enable a low level and/or high resolution dimming. A frequency of repetition of the pulses may be determined by the microprocessor by the time until a following enabling of the converter (by e.g. a following setting of the reference generator and/or a following enabling of the comparator. Thereby, current pulses may be generated e.g. 1, 2, 3 of N (N being an integer) times per cycle time. Furthermore, it is possible to synchronise the switching of the converter to cycle times of the operation of the microprocessor by the described interaction by the microprocessor on the comparator.

The above principle may be applied in a method for dimming of the LED current provided by a driver. The method comprises:

dimming an effective current by disabling the converter (e.g. a hysteretical converter) during a part of cycle time; this may be performed until a level of for example ¼ or ⅛ of the maximum (i.e. 100%) current level. Then, further dimming is provided by dividing a cycle time of the operation in cycle time parts, an example of a cycle frequency could be 300 Hz, as it is a multiple of 50 Hz and 60 Hz mains frequencies and a multiple of common video image capturing frequencies. The cycle time could then for example be divided in 128 parts so as to provide sufficient resolution. Dimming may be performed by during each cycle time part, enabling the converter at a beginning of the cycle time part and disabling the converter during the end of the cycle time part. Prior to the disabling, the value of the reference is increased, so as to force the comparator to switch on the switch, thereby providing for a defined switching off behaviour, a reduction of jitter by the effects of the asynchronous operation of the converter with respect to the cycle time and cycle time parts, and hence a more defined dimming behaviour. A gradual transition towards the situation where the current is increased at the end of each cycle may be obtained by gradually activating this higher current during 1, then 2, then 3, etc cycle time parts of each cycle. With progressed dimming, the part of the cycle time part during which the converter is enabled is made that short that only the part remains where the reference is increased. Further dimming may then be provided by decreasing (e.g. per cycle time part) the value of the reference, and still further dimming may be obtained by keeping the converter shut down during some of the cycle time parts.

Figure 7A:
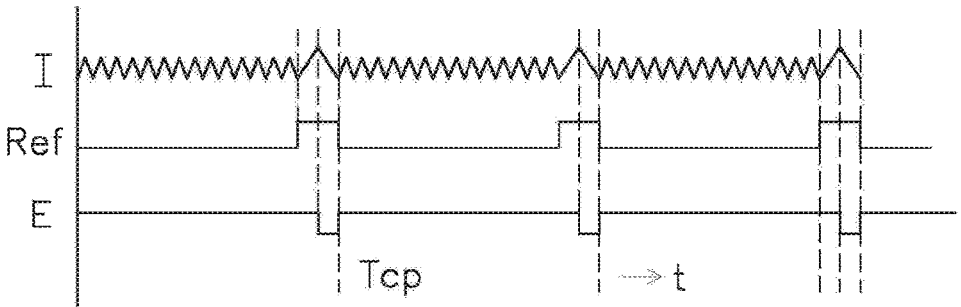
FIGS. 7 A-C depict time diagrams based on which an embodiment of the invention will be described.
Figure 7B:
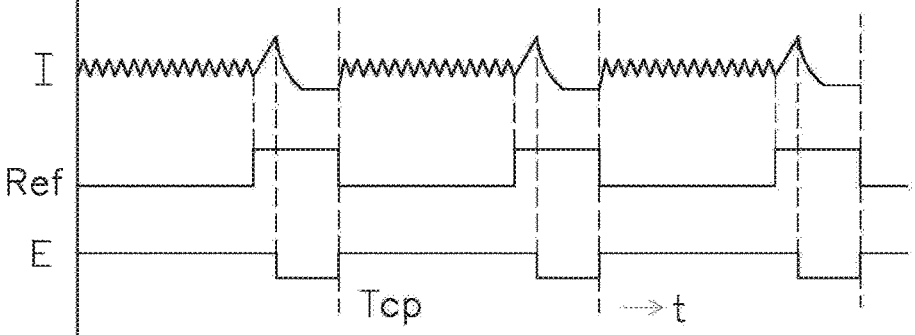
Figure 7C:
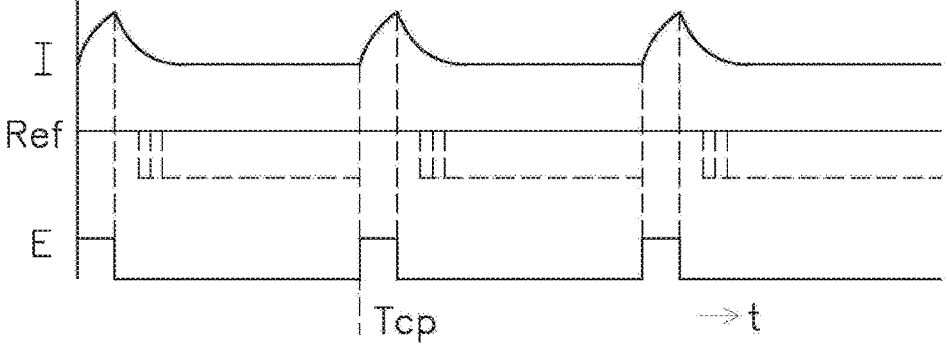

The above process is illustrated in FIGS. 7A-7C. Each of FIGS. 7A-7C depicts the current I of the converter, the reference value Ref and an enable signal E that enables/disables the converter (e.g. by enabling/disabling the comparator), during 3 cycle time parts Tcp. In FIG. 7A, free running operation of the converter is enabled until almost the end of the cycle time part Tcp. Then, the reference is increased which causes an increase of the current to a higher level, followed by a disabling of the converter by a corresponding level of the enable signal E. In FIG. 7B, the same processes are started earlier in the cycle, causing the current of the converter to drop to zero during the final part of each cycle time part Tcp. In FIG. 7C, the dimming has progressed further, causing only the increase of the current. Followed by a decay to zero to remain. Thereto, the reference is set to a high value during at least the part of the cycle time part during which the current increases. Further dimming is possible, as explained above, by a reduction of the pulse height and/or time duration (by reducing the value of the reference and/or a reduction of the enable time during which the converter is enabled) of one or more of the pulses of each cycle. The dimming may be implemented in the driver by e.g. a corresponding programming of the microprocessor or other microcontroller thereof.

Figure 8A:
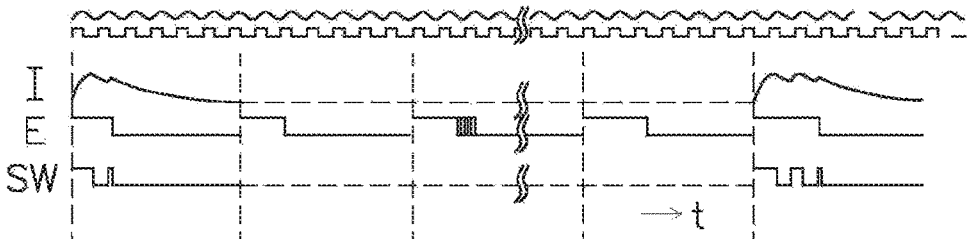
FIGS. 8 A-C depict time diagrams based on which an embodiment of the invention will be described.
Figure 8B:
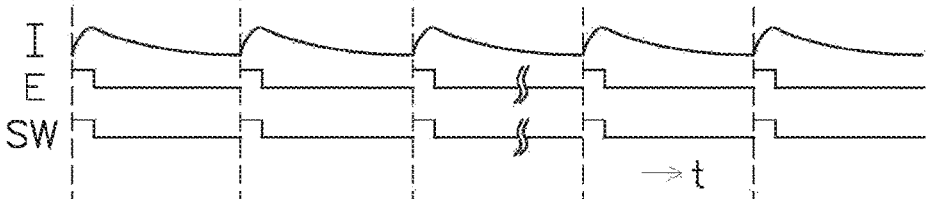
Figure 8C:
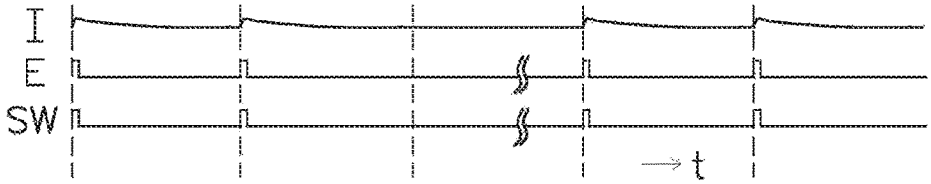

A further embodiment will be explained with reference to FIGS. 8A-8C. In FIGS. 8A-8C, again time diagrams are shown of cycle parts. In this example a cycle is formed by 3326 microseconds (providing approximately 300 Hz cycle frequency) and the cycle is divided in 64 cycle parts. It is remarked that other cycle lengths and other divisions of the cycle in cycle time parts, e.g. in 128 cycle time parts, would be possible as well. In FIG. 8C, a situation is depicted wherein the switch SW of the converter is activated for a short time, namely in this example 0.125 microseconds by enable signal E that enables the converter. As a result, the current I exhibits a peak each time the comparator is enabled. Increasing an intensity, in FIG. 8B, the pulse length during which the current is enabled by E increases to 6.3 microseconds, which provides for a longer current pulse I and reaching a higher level. Hence, in the range of FIG. 8B to FIG. 8C, a relatively direct relation is found between the length of the enable pulse and the current level. A further increase of the enable pulse width E would however result in the comparator to switch to the state during which the switch is in the non-conductive state. As a result, an increase of the pulse width of the enable signal E would not directly translate into an increase in the average current level, until the enable pulse width would be increased that much that the following switching cycle of the free running converter (e.g. the hysteretical converter) would start—at that moment the current would rise again causing a second peak in the same cycle time part, hence an increase in the average current. Hence, a gradual increase in the time during which the converter is enabled within each cycle would result in a rather stepwise increase in the current, hence in the intensity of the LED's. This effect may be at least partly avoided by applying a dithering or other variation to the enable pulse length: instead of a same pulse length in each cycle time part, the length is varied so as to arrive at an average corresponding to the desired cycle time. Therefore, in some of the cycle time parts, the enable time is longer than the average, and in others, the enable time is shorter. An example is illustrated in FIG. 8A. Here, in the first cycle time part, an enable pulse width E of 12 microseconds is applied. In the following cycle time parts, the pulse width is increased in steps of 0.125 microseconds to 20 microseconds. As depicted in FIG. 8A, the comparator and switch SW are activated slightly more than one cycle of the converter in the first cycle time part, while in the last cycle time part the comparator and switch SW of the converter are activated for slightly more than 2 cycles. As a result, the above described effect of a stepwise increase will play a role in some of the cycle time parts, while not playing a role in others. Therefore, an averaging takes place, which may result in a more smooth increase of the LED current and intensity with an increase in the average enable time of each cycle. Thereto, with each increase in intensity level, a an additional pulse may be added: the microprocessor (microcontroller) may for example start with providing a pulse in one of the cycle time parts of the cycle time, and add a pulse in another one of the cycle time part of the cycle time, for each next higher intensity level. The added pulses may be provided in a random one of the cycle time parts of the cycle time. Alternatively, they may be provided in a cycle time that is the most distant in time from the already present pulses:

for example, in case of 64 cycle time parts in a cycle, and having started with a pulse in cycle part 1, the next pulse can be provided by the microprocessor in cycle part 33, as 33 is most distant from 1 in the same cycle time and from 1 in the next cycle time. Thereby, the likelihood that, if a pulse is at least partly in a "dead time", the one to be added next, will be in a "dead time" too, may be reduced, hence allowing a smooth and defined dimming behaviour. In order to take account of the "dead times" whereby the hysteretic converter is inactive by itself, a user set-point may need a recalculation: for very low intensities, (e.g. the case of FIGS. 8B and 8C, a small increase in pulse length or in the number of pulses, will result in a comparably larger increase in intensity, then a same increase in the situation in FIG. 8C, due to the dead times, which are to be taken account of in a calculation of the number of pulses to be added/removed, or the pulse lengths, in response to a changed (user) set-point. A large dimming range may further be obtained. For dimming below the intensities described with reference to FIGS. 8A-8C, the reference (e.g. reference voltage) may be reduced in value so as to reduce amplitude of the remaining current peaks or pulses. The dimming as disclosed here may be described as the controller being arranged to provide enable pulses to enable the comparator in at least two cycle time parts of a cycle time, wherein a pulse length of the enable pulses is varied within each cycle time. The variation of the pulse length smoothens a level increase with increased average pulse length, as the effects of parts of the pulses being in "dead times" between successive active times of the hysteretical converter switching cycle, may be smoothened. The pulse lengths may be varied applying a linear, Gaussian, random or any other suitable distribution.

The dimming as described with reference to FIG. 8A-C may for example be applied in an LED driver comprising the free running converter as described above, however the application is not limited thereto. Rather, it may be applied in any other converter type too. The dimming may be implemented in the driver by e.g. a corresponding programming of the microprocessor MP or other microcontroller thereof. The dimming as described with reference to FIG. 8A-C may be applied for driving different Led groups, each group e.g. having a different colour, each group being e.g. switchable by means of parallel or serial switches so as to energize or de-energize the group. In case of for example 3 groups, in the situation where one or more of the groups is kept at a level below ⅓ of maximum, each such group is assigned its own time slot, and the dimming method as described above may then be applied for each of the groups in that specific slot. In case one of the groups is to be operated at an intensity between ⅓ and ⅔ of maximum, then the group is continuously powered in one of the time slots, and the dimming as specified above is applied in another one of the time slots so as to allow accurate and high resolution controlling of the intensity of the respective group. In addition to the schematic diagram as depicted in FIG. 6, use may be made of a voltage divider to lower a voltage over the LED's to a voltage within a range of measurement of the microprocessor (i.e. the controller). At low light intensities and lower current levels, this divider may have an effect on the effective current through the LED's, as a part of the current may then flow through the divider instead of through the LED's. Furthermore, the value of the resistive divider may have an effect on the decay of the pulse—i.e. the energy stored in the inductor. In an embodiment, a lower resistance value is chosen for the divider at low current values, to thereby provide a faster decay of the pulses at low current levels. At higher current values, a higher resistance value may be chosen (e.g. by suitable switching means under control of the microprocessor) for efficiency reasons.

Figure 9:
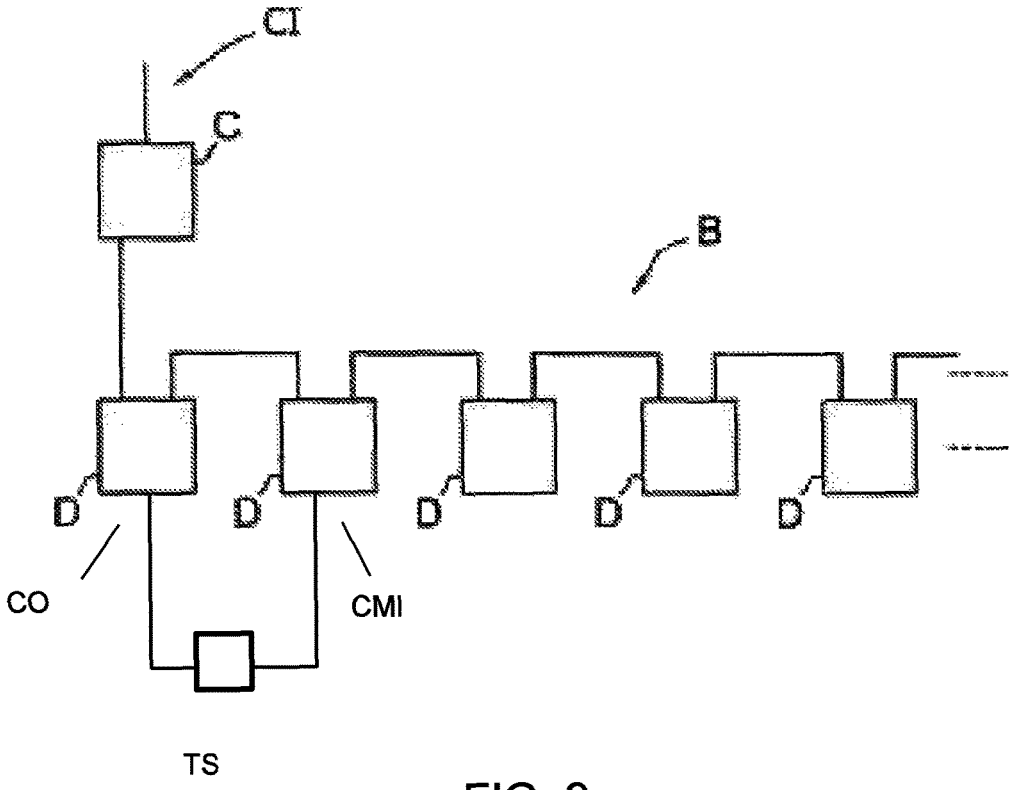
FIG. 9 depicts an embodiment of a driver structure in accordance with an aspect of the invention.

FIG. 9 depicts a driver system comprising a testing switch TS to connect, in a conductive state thereof, a current output CO of a first one of the driver modules D to a current measurement input CMI of a second one of the modules D, the control module being arranged to test the first one of the driver modules by setting the testing switch to a conductive state and measuring the current supplied by the first one of the driver modules via the second one of the driver modules.

Figure 10:
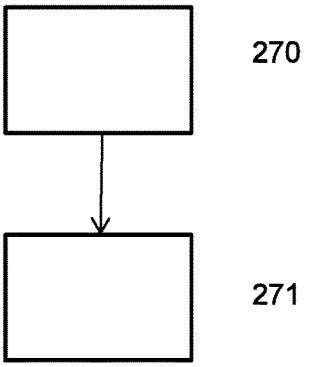
FIG. 10-13 each depict a flow diagram illustrating an embodiment of the invention.

FIG. 10 depicts in step 270 that the driver module measures a voltage over the at least one LED that is to be driven, and in step 271 that an error message is generated in case the measured voltage is below a predetermined threshold.

Figure 11:
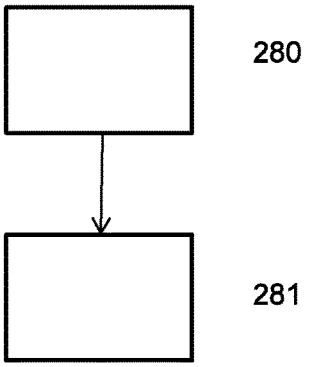

FIG. 11 depicts in step 280 that the driver module measures a voltage over the at least one LED that is to be driven, and in step 281 that an error message is generated in case the measured voltage is above a predetermined threshold.

Figure 12:
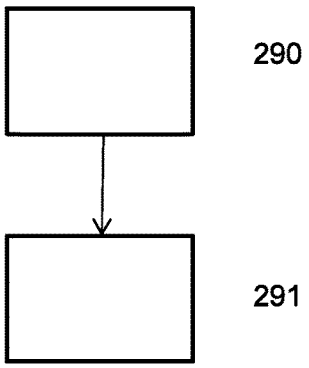

FIG. 12 depicts in step 290 that the control module activates one of the driver modules, to perform a check of the operation of that driver, prior to in step 291 activating another one of the driver modules.

Figure 13:
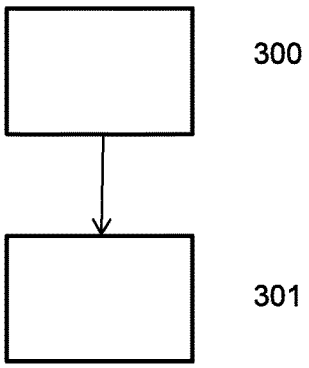

FIG. 13 depicts in step 301 that the control module sends an increased setpoint to at least one of the drivers when In step 300 an error condition in another one of the driver modules has been detected.

The invention claimed is:

1. A driver system for driving a plurality of LED's, the driver system comprising:

a control module having an input for receiving operating data; and at least two driver modules, each driver module for driving at least one of the LED's, each of the driver modules comprising:

a hysteretical converter for generating an LED current to power the LED's, and a controller electrically connected to the hysteretical converter for controlling the hysteretical converter, wherein each of the driver modules comprises a respective reference signal generator for generating a respective reference signal, the reference signal generator being connected to a setpoint input of the hysteretical convertor to provide the respective reference signal to the setpoint input of the hysteretical convertor, causing each driver module to generate, by its respective hysteretical convertor its own LED current proportional to the respective reference signal, wherein each of the driver modules receives the same supply voltage, and further wherein the controller of each of the driver modules is configured to measure a value of the supply voltage thereby using the reference signal provided by the reference signal generator of the respective driver module as a reference, and thereby comparing by each driver module the supply voltage with the reference signal of the reference signal generator of that respective driver module, control module being configured to calibrate the LED currents of the driver modules in respect of each other by comparing the measurements of the value of the supply voltage of the at least two driver modules with each other and calibrating the reference signal generators of the at least two driver modules in respect of each other based on a difference between the measurements of the value of the supply voltages by the driver modules, whereby each driver module measures the same supply voltage using its own reference signal generator as its respective reference.

2. The driver system according to claim 1, wherein the hysteretical converter comprises:

a switch;

an inductor, in a series connection with the switch, the switch to in a conductive state thereof charge the inductor;

a current measurement element to measure a current flowing through at least one of the inductor and the LED illumination device;

wherein the switch, inductor and current measurement element are configured to establish in operation a series connection with the LED illumination device;

and further wherein the hysteretical converter further comprises:

a comparator to compare a signal representing the current measured by the current measurement element with the reference signal, an output of the comparator being provided to a driving input of the switch for driving the switch, and wherein the controller is configured to control an operation of at least one of the reference signal generators and the comparator.

3. The driver system according to claim 2, wherein the comparator further comprises an enable input for enabling or respectively disabling the comparator, the enable input being connected to the controller to be driven by the controller.

4. The driver system according to claim 2, wherein at least one reference signal generator comprises a control input for setting a value of the reference signal, the control input of the at least one reference signal generator being connected to the controller to be driven by the controller.

5. The driver system according to claim 2, wherein at least the controller and the comparator are integrated on a same chip.

6. The driver system according claim 2, wherein the controller is configured to:

detect a short circuit or no load condition of the converter;

drive at least one reference signal generator so as to reduce a value of the reference signal;

retry to activate the converter after waiting for a predetermined wait time period, whereby the at least one reference signal generator is kept at the reduced value of the reference signal; and detect if the activation of the converter succeeded and to drive the at least one reference signal generator so as to bring the reference signal back to a normal level.

7. The driver system according to claim 6, wherein the detecting the short circuit or no load condition of the converter comprises detecting whether a switching of the comparator has stopped.

8. The driver system according to claim 6, wherein driving at least one reference signal generator occurs gradually or stepwise.

9. The driver system according to claim 1, wherein a connection between the control module and the driver modules is a single wire connection.

10. The driver system according to claim 1, wherein the control module is configured to measure the supply voltage and to send data representing a value of the supply voltage to each driver module.

11. The driver system according to claim 1, comprising a testing switch to connect, in a conductive state thereof, a current output of a first one of the driver modules to a current measurement input of a second one of the modules, the control module being configured to test the first one of the driver modules by setting the testing switch to a conductive state and measuring the current supplied by the first one of the driver modules via the second one of the driver modules.

12. The driver system according to claim 1, wherein, as a startup procedure, the control module is configured to test the first one of the driver modules by activating the hysteretical converter of the first one of the driver modules and requesting from each driver module a current measurement.

13. The driver system according to claim 1, wherein each driver module is configured to measure a voltage over the at least one LED that is to be driven, and to generate an error message in case the measured voltage is below a predetermined threshold, the error message associated with a reverse polarity protection diode going into a conductive state and a forward voltage detected.

14. The driver system according to claim 1, wherein each driver module is configured to measure a voltage over the at least one LED that is to be driven, and to generate an error message in case the measured voltage is above a predetermined threshold, the error message indicating an open circuit is detected.

15. The driver system according to claim 1, wherein the control module is configured to activate one of the driver modules, to perform a check of the operation of that driver, prior to activating another one of the driver modules.

16. The driver system according to claim 1, wherein the control module is configured to send an increased setpoint to at least one of the driver modules when an error condition in another one of the driver modules has been detected and the other driver module of the at least two driver modules is switched off.

17. The driver system according to claim 1, wherein the control module comprises an analogue input having a low pass filter, the control module being configured to derive a setpoint information from a level at the analogue input, the control module being further configured to provide an electrical pulse onto the analogue input, to measure a decay of the electrical pulse in the filter, and to determine where or not a setpoint source is connected from a decay of the electrical pulse in the filter.

* * * * *